United States Patent [19]

Bihler et al.

[11] Patent Number: 4,696,178

[45] Date of Patent: Sep. 29, 1987

[54] WIRE AND BAND PROCESSING MACHINE

[75] Inventors: Otto Bihler, Halblech, Fed. Rep. of Germany; Eduard Brüller, Trimbach, Switzerland

[73] Assignee: Otto Bihler, Halblech, Fed. Rep. of Germany

[21] Appl. No.: 895,518

[22] Filed: Aug. 11, 1986

Related U.S. Application Data

[63] Continuation of Ser. No. 736,525, May 21, 1985, abandoned, which is a continuation of Ser. No. 463,556, Feb. 3, 1983, abandoned.

[30] Foreign Application Priority Data

Feb. 16, 1982 [DE] Fed. Rep. of Germany ..... 3205493

[51] Int. Cl.[4] ..... B21F 1/00

[52] U.S. Cl. ..... 72/384; 72/444; 72/403; 72/449; 72/481; 140/105

[58] Field of Search ..... 72/449, 441, 442, 444, 72/404, 234, 181, 481, 384; 140/105

[56] References Cited

U.S. PATENT DOCUMENTS

| | | | |
|---|---|---|---|
| 242,616 | 6/1881 | Edge | 140/105 |
| 1,524,772 | 2/1925 | Wright | 72/234 |
| 1,578,141 | 3/1926 | Lange et al. | 72/234 |
| 1,786,348 | 12/1930 | Keyser | 74/665 GD |
| 1,913,361 | 6/1933 | Burns | 72/234 |
| 2,163,672 | 6/1939 | Ferris | 74/665 GD |
| 3,296,851 | 1/1967 | Breuer | 72/383 |
| 3,440,859 | 4/1969 | Holtzhauer | 72/404 |
| 3,469,469 | 9/1969 | Karl-Heinz Burger | 74/425 |
| 3,945,239 | 3/1976 | Russell | 72/452 |

FOREIGN PATENT DOCUMENTS

| | | |
|---|---|---|
| 2457048 | 6/1976 | Fed. Rep. of Germany . |
| 2741576 | 9/1977 | Fed. Rep. of Germany . |
| 2403129 | 4/1979 | France . |

*Primary Examiner*—Robert L. Spruill
*Assistant Examiner*—David B. Jones
*Attorney, Agent, or Firm*—Toren, McGeady & Associates

[57] ABSTRACT

In a wire and band processing machine, a drive system is positioned on one side of a processing plate and a fastening arrangement is provided for mounting processing units on the other side of the processing plate. The processing units are connected to the drive system through holes in the processing plate. The drive system includes at least one worm shaft extending parallel to the processing plate and a worm gear can be releasably positioned in meshed engagement with the worm shaft. The axis of the worm gear extends perpendicularly to the processing plate and to the worm shaft.

63 Claims, 13 Drawing Figures

WIRE AND BAND PROCESSING MACHINE

This is a continuation of application Ser. No. 736,525, filed May 21, 1985, now abandoned, which is a continuation of Ser. No. 463,556, filed Feb. 3, 1983, now abandoned.

SUMMARY OF THE INVENTION

The present invention is directed to a wire and band processing machine including at least one processing plate with a plurality of holes extending through the plate, a drive system located on one side of the processing plate, processing units located on the opposite side of the processing plate and fastening means securing the processing unit to the processing plate, each of the processing units can be coupled through one of the holes in the processing plate to the drive system.

Such a wire and band processing machine is disclosed in U.S. Pat. No. 4,203,477. The machine has, for the most part, proven to be excellent. When particularly high tangential forces occur, however, it has been found difficult to provide the desired freedom from play in the spur wheels of the drive system. The requisite freedom from play between two drive units driven by the spur wheels and connected by a plurality of intermediate wheels can be effected by pairing the spur gears during assembly. Therefore, the primary object of the present invention is to construct a wire and band processing machine of the above type so that when high forces occur in the processing units and are transferred by the drive system, an even higher freedom of play is assured between different processing units and/or between processing units and a material feed.

In accordance with the present invention, the drive system is provided with at least one worm shaft extending parallel to the processing plate and a processing unit can be placed in engagement with or disengaged from the worm shaft by a worm gear having an axis extending perpendicularly to the processing plate.

It can easily be seen that the omission of the spur wheel transmission provided in U.S. Pat. No. 4,203,477 and which has a plurality of successive spur wheels only excludes the introduction of play between two successive spur wheels with appropriate measures.

In the specification and claims, when reference is made to a wire and band processing machine, the following processing operations can be effected: bending, punching, welding, and the assembly of bent and/or punched parts.

In the known embodiment, the connection between a processing unit and the drive system can be effected when a driving pinion, having radial serrations, combined with the corresponding processing unit, and supported in a bearing on the processing unit, is placed into engagement with a spur gear of the driving system through a hole in the processing plate or at an edge of the plate. Accordingly, the installation and removal of processing units in this known embodiment is simple, and this is true in the present invention, since it is necessary to provide for the simple installation and removal of the processing units.

In a first embodiment of the present invention the worm gear is placed in meshed engagement with only a portion of the peripheral surface of the worm gear shaft so that the worm gear can be placed in and removed from the meshed engagement with the worm shaft in the direction of its axis. In this arrangement, the worm gear can be placed in or removed from engagement with the worm shaft by slightly rotating either the worm shaft or the worm gear. Therefore, it is unnecessary to take any additional action for coupling a processing unit to the drive system. In this embodiment so-called semi-worm gears are used as are illustrated in the drawing and described. The use of such semi-worm gears can be omitted if the bearing means for the worm gear can be installed so that a certain amount of radial play is available during installation or removal.

Another possibility for maintaining the simple assembly and disassembly of the processing units, while adhering to the basic concept of the invention, involves the support of the worm gear within the corresponding hole in the processing plate by means of the worm gear shaft. The end of the worm gear spaced from the worm gear shaft can be provided with a coupling arrangement for engagement with a counter coupling arrangement on the processing unit. In this embodiment, it is possible to provide a worm gear in each of the holes through the processing plate for installing the processing units with such a coupling arrangement. Accordingly, when a processing unit is installed it is only necessary to place the counter coupling arrangement of the processing unit in engagement with the coupling arrangement of the worm gear.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
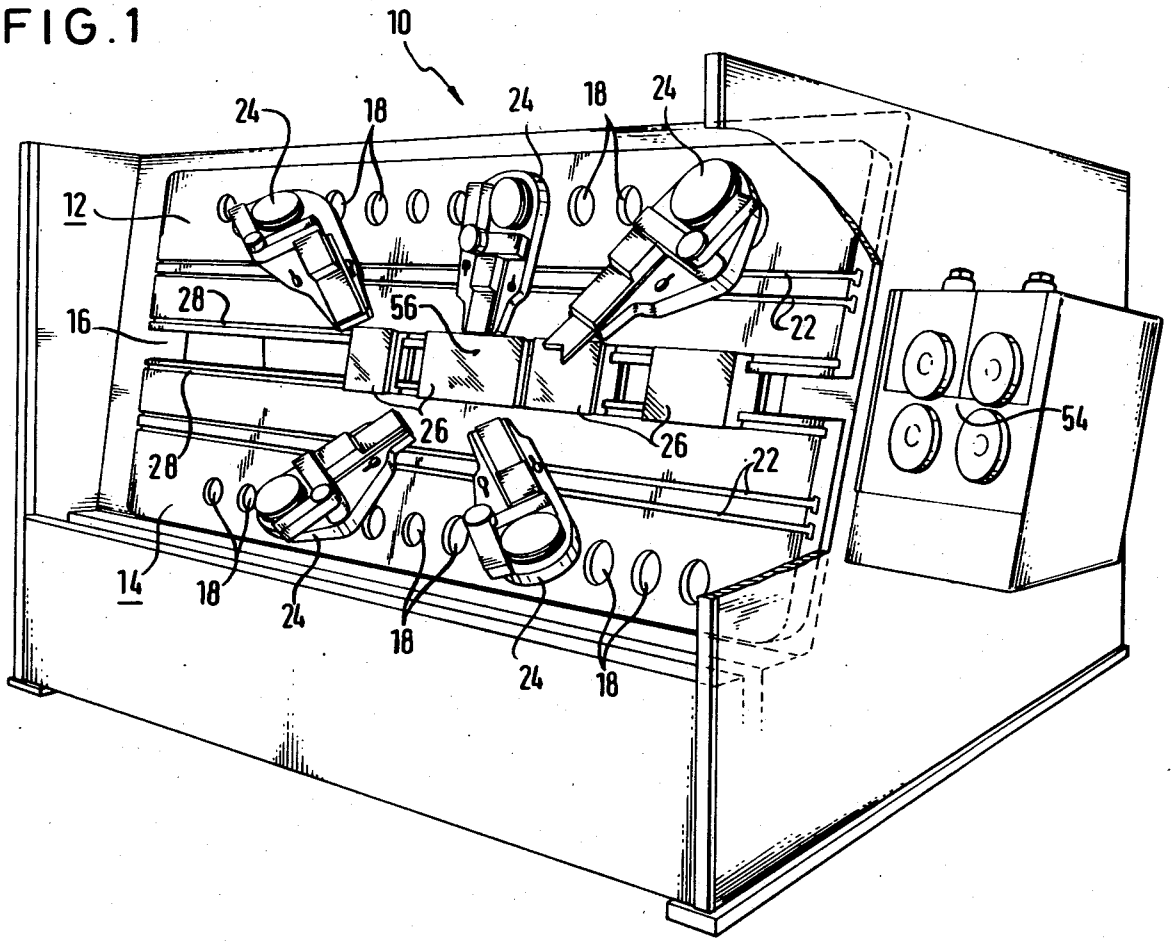
FIG. 1 is a perspective view of a wire and band processing machine embodying the present invention.

A wire and band processing machine 10 is shown in FIG. 1. The machine includes two processing plates 12, 14 extending generally parallel to one another and spaced apart forming a slot 16 between them. Each processing plate 12, 14 is provided with a plurality of holes extending along a rectilinear row. Undercut T-grooves 22 are formed in each of the processing plates 12, 14 and processing units 24 can be fastened to the plates by engagement within the grooves. The processing units 24 can be rotated about the axes of the holes 18 through the processing plates in any desired direction. The driving connection between the processing units and a drive system is effected through the holes 18. The drive system is located on the opposite side of the processing plates from the side mounting the processing units. Slot 16 can be bridged by a plurality of bridging pieces 26 shaped for engagement within grooves 28 located in the processing plates and extending along the slot 16. The bridging pieces 26 can be positioned at any location within the grooves 28 along the slot 16 and can be held in place by clamping means, not shown.

Figure 2:
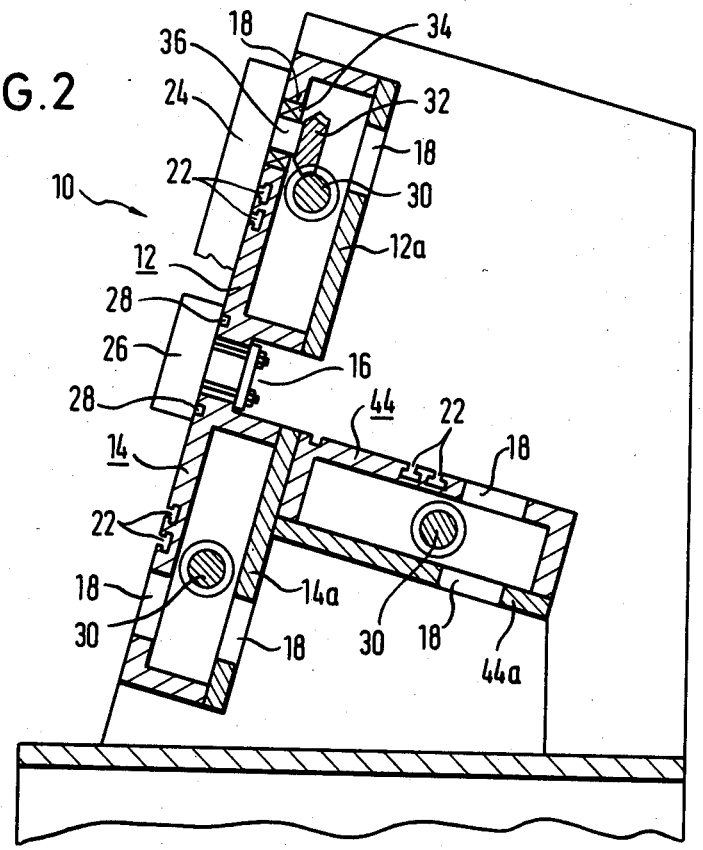
FIG. 2 is a cross-sectional view through the machine shown in FIG. 1.

In the section of the machine shown in FIG. 2, additional details can be noted.

As can be seen in FIG. 2, processing plate 12 is formed as a U-shaped section with the legs of the U-section extending away from the side on which the processing units are mounted. An additional plate 12*a* bears against the free ends of the legs of the U-shaped section of processing plate 12 and the combination of the two plates forms a box section. The same arrangement is present in the processing plate 14. As can be seen in FIG. 2, the drive system includes a worm shaft 30 arranged in the open space within the processing plates 12, 12*a* and extending in the median plane between them. The worm shaft extends parallel to the processing plate 12 and is supported at the ends of the machine and, if necessary, at one or more locations in between. The worm shaft may be divided so that the locations of the divisions advantageously coincide with possible bearings between the ends of the machine. Processing unit 24 is in engagement with the shaft 30 within the processing plates 12, 12*a* and is supported in a hole 18 by a roller bearing arrangement 34 or the like. Further details of this arrangement are shown in FIG. 3.

Figure 3:
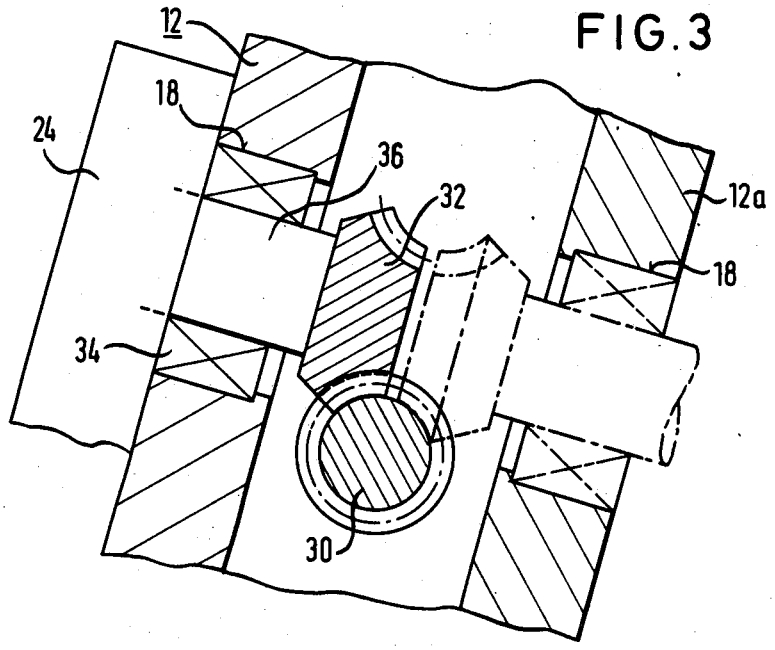
FIG. 3 is an enlarged detail shown in section of a first embodiment of the present invention as illustrated in FIG. 1.

In FIG. 3 it can be clearly noted that the worm gear 32 is constructed as a semi-worm gear. Semi-worm gear 32 is in meshed engagement with the worm thread of the worm shaft 30 so that the worm gear 32 located on the end of the worm gear shaft 36 can be placed into and removed from engagement with the worm gear shaft by a slight rotation of the worm gear shaft or of the worm gear. The release from engagement can be effected in the same manner. During the insertion and removal of the worm gear the bearing 34 is also inserted or removed. It is also possible to provide an arrangement in which the bearing 34 can be removed separately, that is, while the worm gear 32 is still in engagement with the worm shaft 30 so that the worm gear shaft 36 can be moved radially relative to the hole 18 through which it extends. It would also be possible to replace the semi-worm gear 32 with a full worm gear and still assure easy installation and removal. In FIG. 3 two aligned holes 18 are shown, one in each of the two processing plates 12, 12*a*, and worm gear shafts with worm gears can be inserted through each hole as is shown in FIG. 3 with one worm gear shown in full line and the other worm gear shown in dot-dash line.

Figure 4:
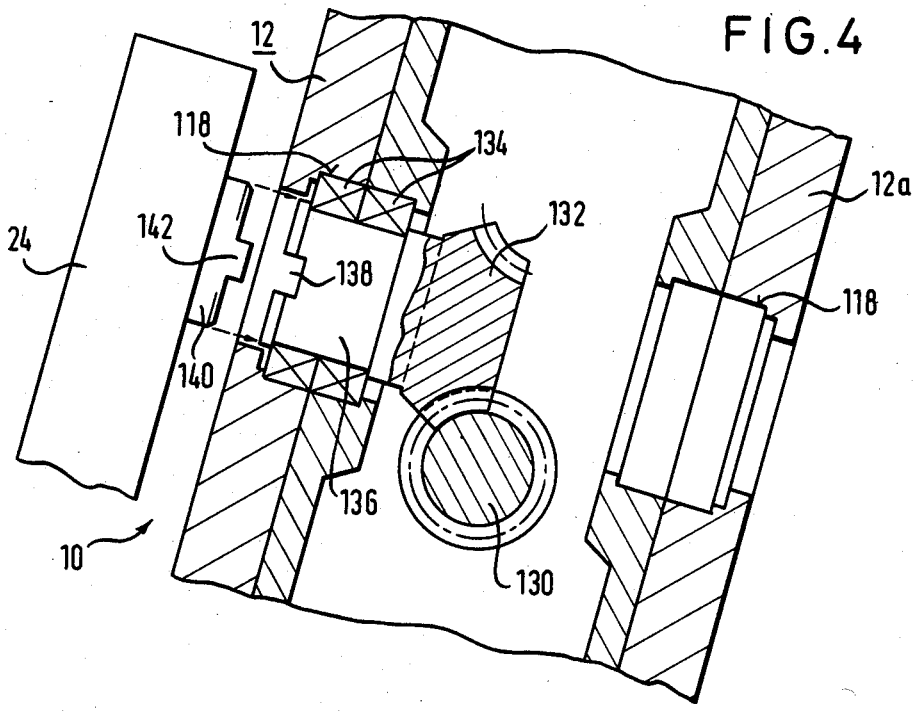
FIG. 4 is an enlarged detail shown in section of a second embodiment of the present invention.

Another embodiment is illustrated in FIG. 4. Similar parts are provided with the same reference numerals, but with the addition of 100. In this embodiment, the worm gear shaft 136 is formed as a stub shaft supported within the bearing 134. Each hole 118 is provided with a stub shaft and a corresponding semi-worm gear 132. As viewed in FIG. 4, the left-hand end of the worm gear shaft 136 provides a coupling arrangement 138 in the form of a diametral slot. The processing unit 24 has a stub shaft 140 provided with a counter coupling arrangement in the form of a diametral rib 142. In this way, the attachment of the processing unit 24 is possible in a very simple manner without requiring the engagement and disengagement of the worm gear shaft 136 with the worm gear 132. In this embodiment, it would also be possible to permit the worm gear 132 to mesh with a larger peripheral section of the worm thread on the worm shaft 130, unless the occupation of aligned holes 118 is intended, as shown in FIG. 3.

Figure 5:
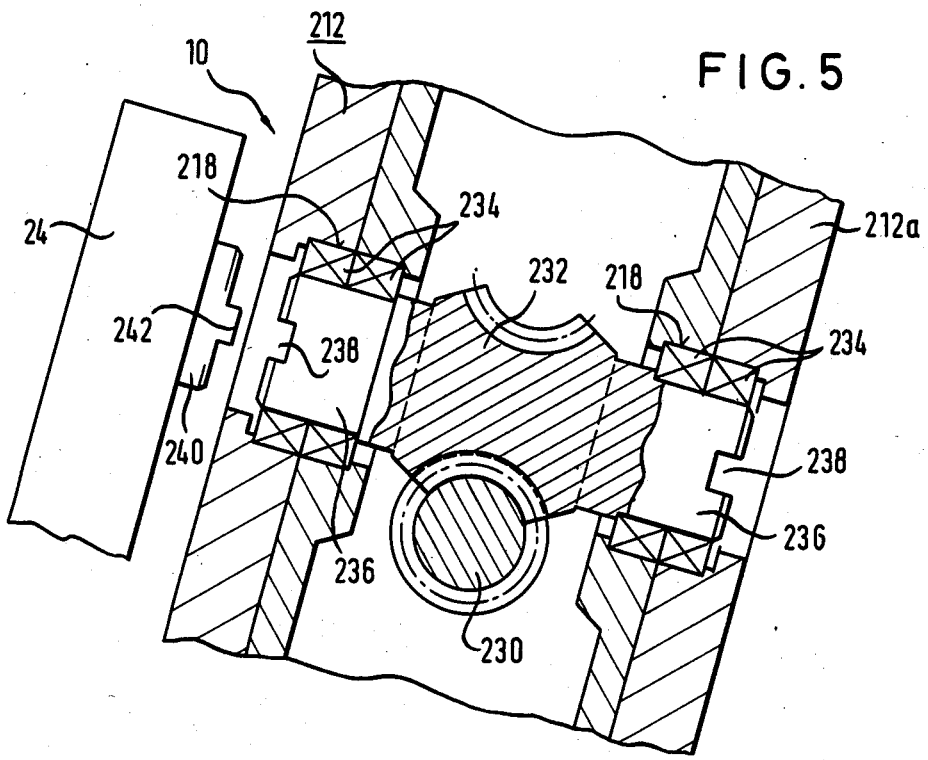
FIG. 5 is an enlarged detail shown in section of a third embodiment of the present invention.

In FIG. 5 another modification is shown of the arrangement according to FIGS. 2, 3 and 4, with similar parts provided with the same reference numerals as in FIGS. 2 and 3, however, with the addition of 200. In this embodiment, a double shaft stub 236 is supported in two aligned holes 218 each in one of the processing plates 212, 212*a*. Intermediate its ends, the double shaft stub 236 is combined with a worm gear 232. Each end of the double shaft stub 236 has a coupling arrangement 238. Each of the holes 218 may be occupied with such double stub shafts. The attachment of the processing units is effected in exactly the same manner as shown in FIG. 4 and described in the corresponding part of the specification.

Figure 6:
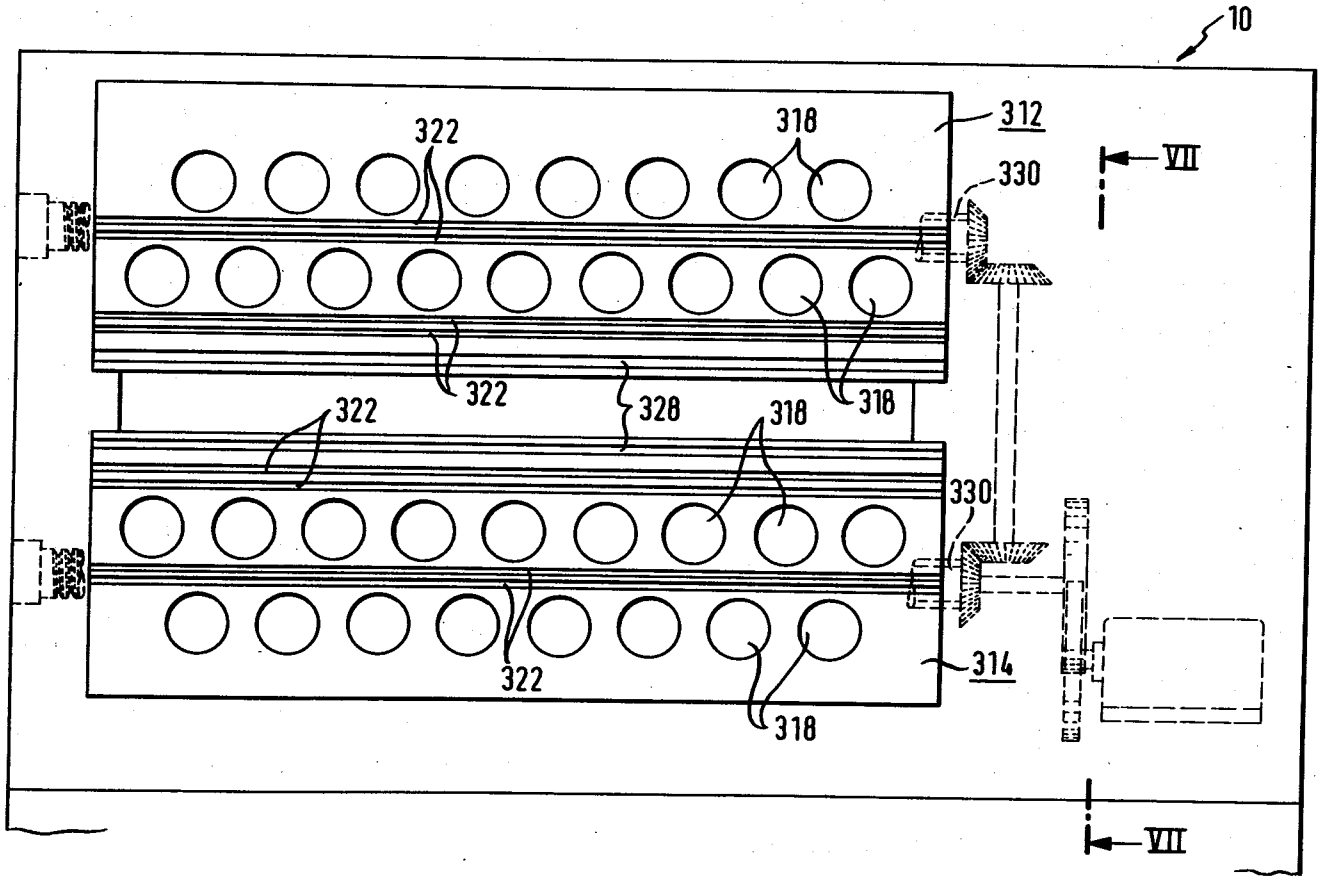
FIG. 6 is a front view of a wire and band processing machine incorporating the embodiment disclosed in FIG. 3.

FIG. 6 illustrates another embodiment as compared to the one shown in FIG. 1 with each processing plate 312, 314 having two rectilinear rows of holes 318 with the holes in one row staggered relative to the holes in the other row.

As can be seen in FIG. 2, additional processing plates 44, 44*a*, with a similar arrangement of holes 18, T-grooves 22 and worm shaft 30, extend generally perpendicularly to the processing plates 14, 14*a*. With this arrangement, additional processing units can be positioned on the processing plate 44 in any desired angular position, disposed in the plane of the processing plate 44, so that these processing units can operate through the slot 16 toward a processing area.

Figure 6A:
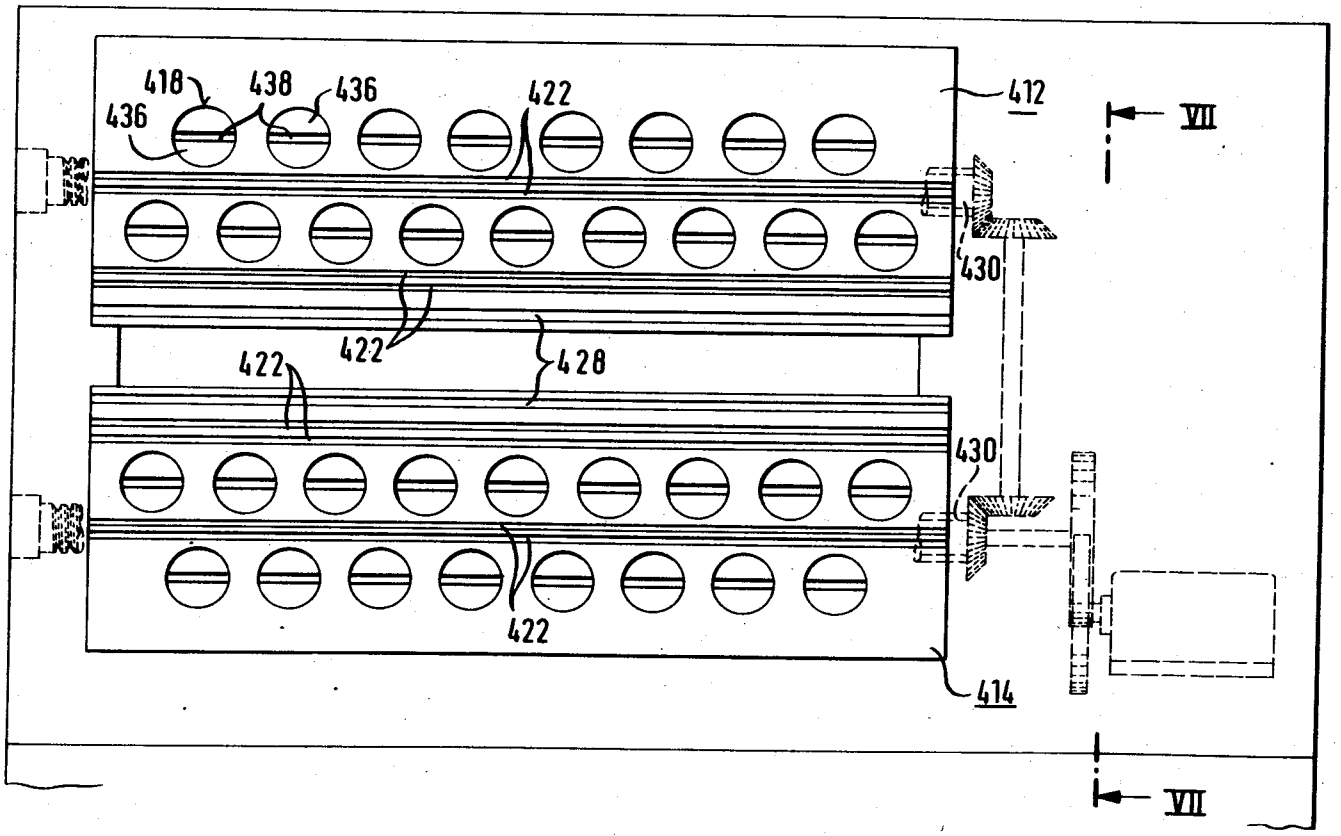
FIG. 6A is a front view, similar to that in FIG. 6, incorporating the embodiments such as shown in FIGS. 4 and 5.

In FIG. 6A an embodiment is shown which corresponds to that in FIG. 6, however, the ends of the stub shafts 436 are provided with coupling arrangements 438 such as illustrated in FIGS. 4 and 5.

Figure 7:
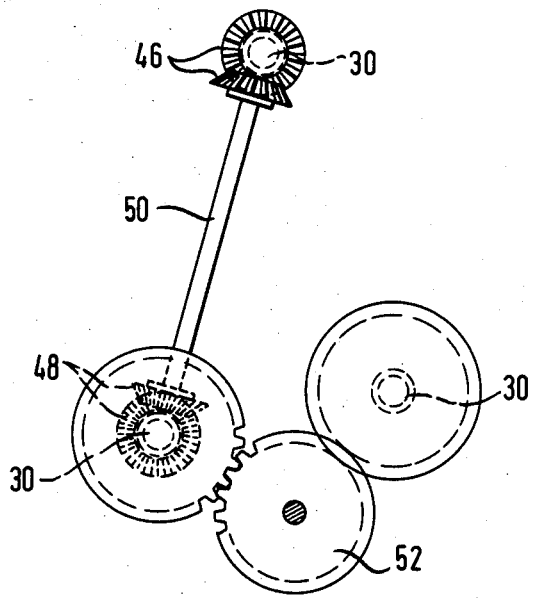
FIG. 7 is a drive diagram for a machine containing the embodiments of FIGS. 2, 6 and 6A.

In FIG. 7 a drive arrangement is shown for the worm shafts 30. The three shafts 30 of FIG. 2 are shown in FIG. 7 arranged to be driven synchronously by bevel gear pairs 46, 48 located at the opposite ends of an intermediate shaft 50, and by an intermediate spur wheel 52. The drive for the three shafts can be provided by the intermediate spur wheel 52.

Referring back to FIG. 1, the machine 10 has a material feed 54 located at one end of the machine for feeding material in front of the processing plates 12, 14 to a processing area 56 located along the slot 16 where a workpiece can be operated on by several processing units 24.

In FIGS. 6 and 6A, the drive means illustrated in FIG. 7 are shown in phantom lines.

Figure 8:
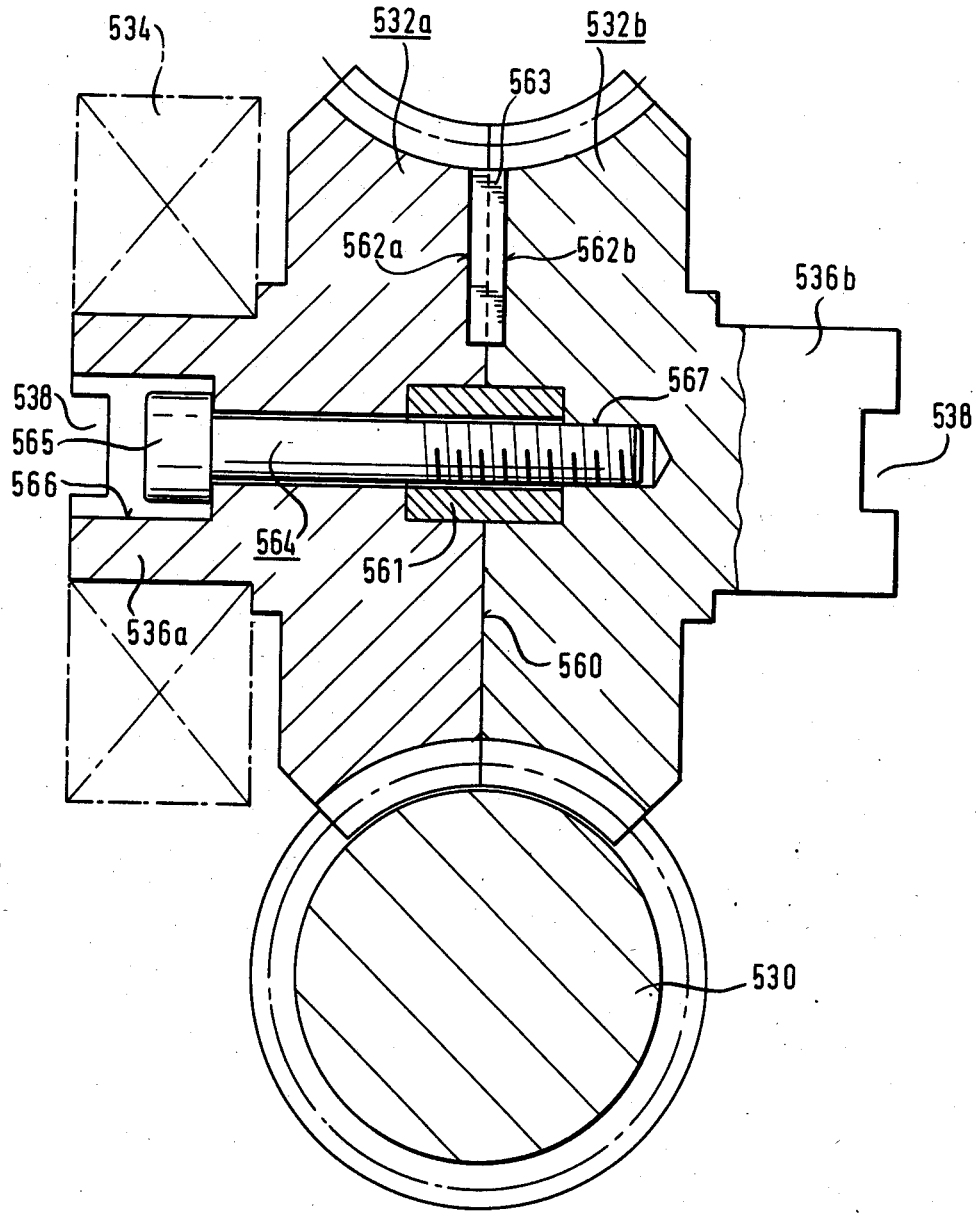
FIG. 8 is a modification of the embodiment shown in FIG. 5.

In FIG. 8, similar parts are provided with the same reference numerals as in FIG. 5, however, with the addition of 500. In this embodiment, the worm gear is divided into two worm gear halves 532*a*, 532*b* in contact with one another along a central division plane. Worm gear halves 532*a*, 532*b* are centered relative to one another by a centering bushing 561 and are secured together in the rotational direction by a wedge 563 inserted into the complementary radial grooves 562*a*, 562*b*, and the gear halves are held together by a clamping screw 564 having its head bearing against the bottom of a recess 566 in one of the gear halves 532*a* and with the other end of the clamping screw screwed into a threaded bore 567 in the other worm gear half 532*b*. This embodiment has all of the advantages of the embodiment in FIG. 5, however, it has the further advantage that the two worm gear halves 532*a*, 532*b* can be separated and inserted or removed through the corresponding holes in the processing plates while rotating one of the worm shaft or the worm gear, assuming of course that the diameter of the bearing 534 is of a correspondingly large size. Basically, the embodiment shown in FIG. 8 would also be applicable to an installation arrangement such as shown in FIG. 3 where one of the processing units is installed through one of two oppositely located holes. Accordingly, for force transmission, twice the gear tooth widths is available which reduces wear and permits transmission of larger torques.

Figure 9:
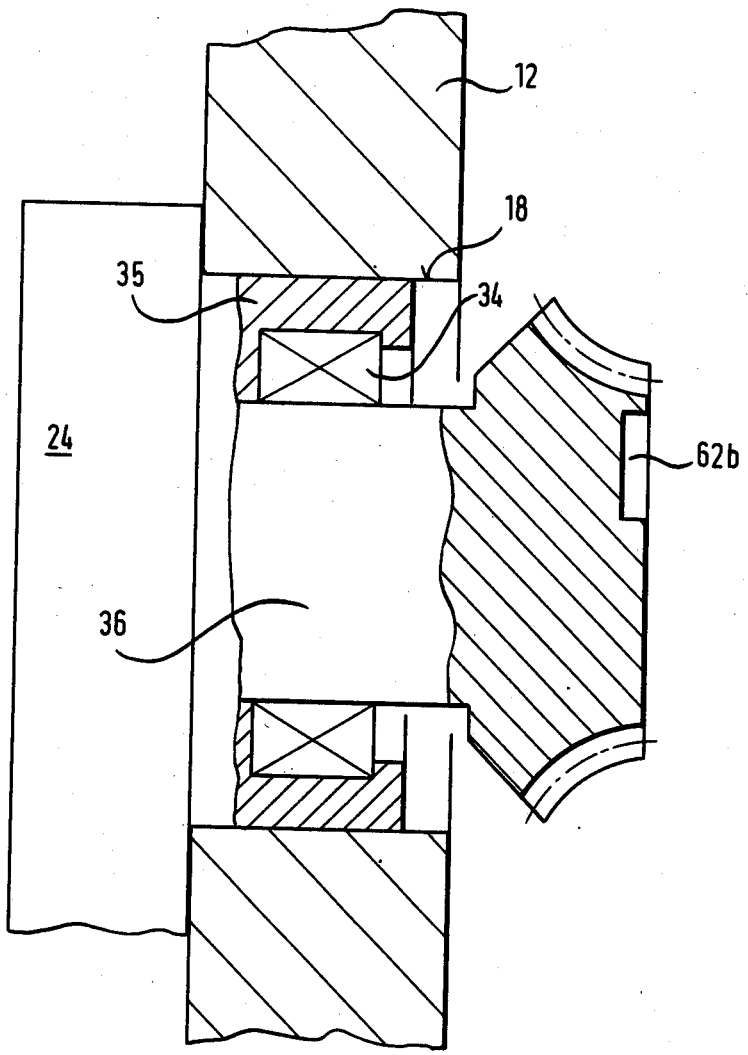
FIG. 9 is a modification of the embodiment shown in FIG. 2.

In FIG. 9 which is a variation of the embodiment in FIG. 3, the bearing 34 supporting the worm gear shaft 36 can also include a bearing bushing 35 formed as a part of the processing unit 24 so that the installation and removal of the processing unit is further facilitated. Formation of the holes 18 becomes simpler with such an arrangement. Further, in FIG. 9, a radial groove 62*b* is shown which affords the connection to an oppositely located worm gear.

Figure 10:
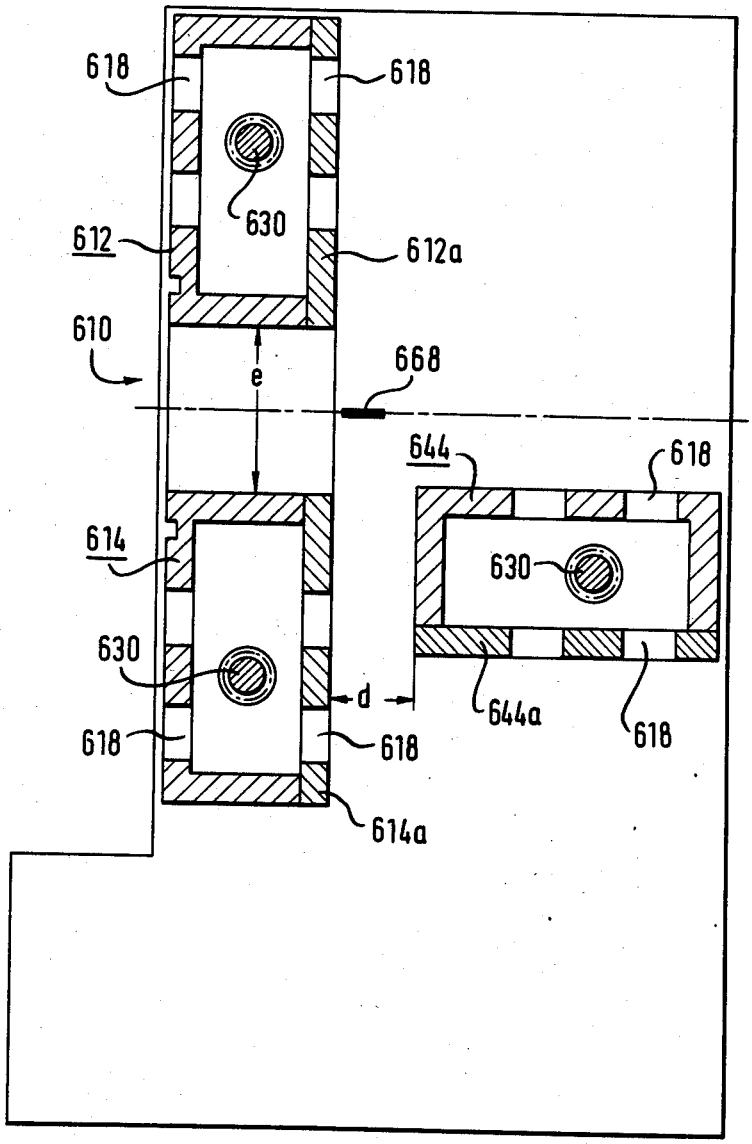
FIG. 10 illustrates another modification of the arrangement shown in FIG. 2.

In FIG. 10, similar parts are provided with the same reference numerals, however, increased with 600, with the processing plates 644, 644*a* forming a box section containing a worm shaft 630. The processing plates 644, 644*a* extend perpendicularly of the processing plates 614, 614*a* and the surfaces of the plates 644, 644*a* adjacent to the common plane of the processing plate 612, 614*a* are spaced apart by a gap d. This arrangement permits the processing plate 614*a* to be completely equipped with processing units. Further, a novel choice of the processing area is afforded in the embodiment in FIG. 10 where the workpiece 668 is located in the intersection of the gap d and the gap e located between the processing plates 612*a*, 614*a*. In this arrangement the plates 612, 612*a*, 614, 614*a* are arranged in a vertical plane, while the other processing plates 644, 644*a* are disposed in a horizontal plane.

Figure 11:
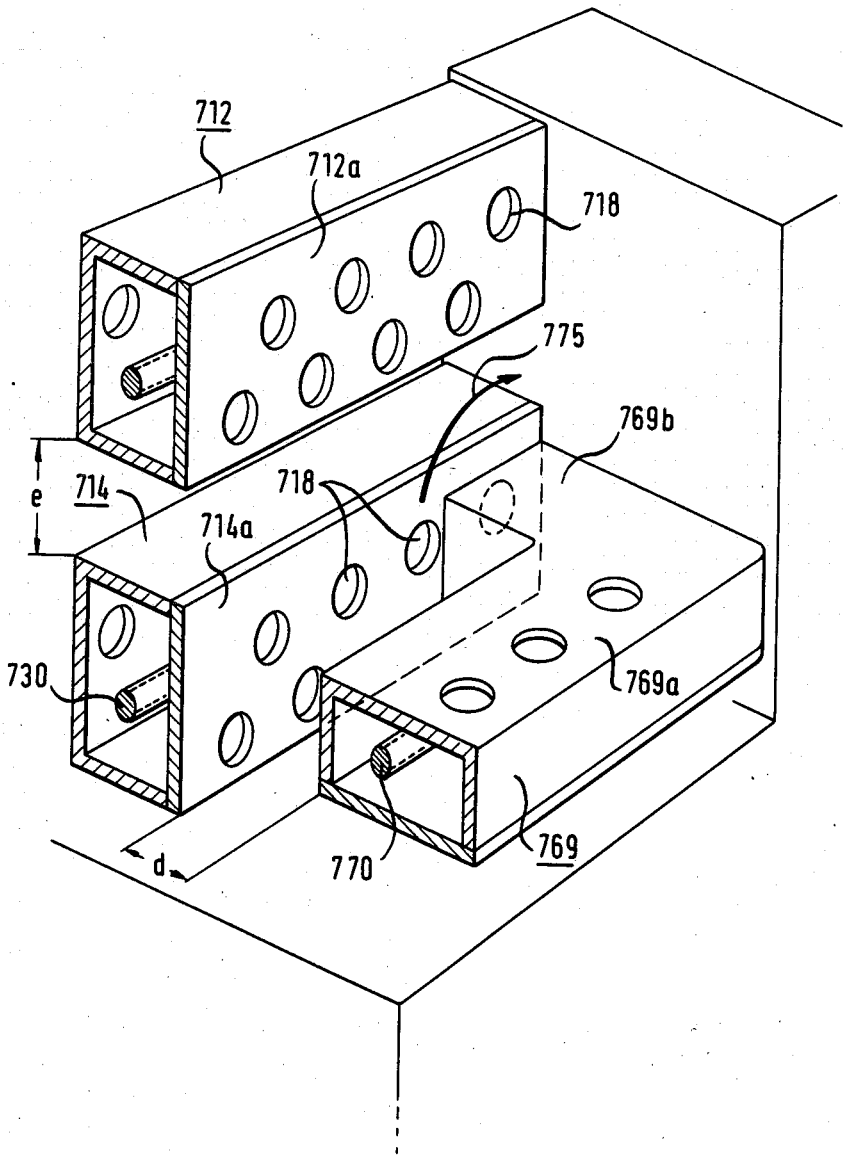
FIG. 11 exhibits a third modification of the arrangement shown in FIG. 2.

In FIG. 11 another additional interesting possibility for positioning the processing plates is shown affording an expansion of the functions of the processing machine. In this embodiment, an additional L-shaped processing plate 769 is attached to the processing plate 714*a*. Processing plate 769 has a long side 769*a* and a short side 769*b*. Attachment of the processing plate 769 to the processing plate 714*a* may take place exclusively or partially at the processing plate 714*a* possibly by means of dovetailed grooves, not shown, formed in the processing plate 714*a*. Usually additional fastenings will be necessary, and they can be located at a machine stand illustrated only schematically in FIG. 11. The long side 769*a* of the processing plate extending from the short side 769*b* is separated from the processing plate 714*a* by a gap d. As can be seen in FIG. 11, extending parallel to the long side 769*a* is a worm shaft 770 which is connected by an angular drive 771 to a connecting shaft 772, note FIG. 12. Connecting shaft 772 is provided at its end remote from the angular drive 771 with a diametral rib 773 engaged in a diametral slot 774 of worm gear shaft 736. With the coupling 773, 774, it is possible to attach the processing plate 769 into different holes 718 of the processing plate 714*a*. In addition, it is possible to adjust the processing plate, shown in FIG. 11 in the horizontal position, by moving it in the direction of the arrow 775, note FIG. 11. Angular drive 771 shown formed by two meshing bevel gears may be adjusted to the corresponding desired speed of the worm shaft 770. The support of the processing plate 769 is not shown in detail, however, it would be easy to visualize how this processing plate can be supported and secured on a solid machine stand. To make the processing plate 714*a* as shown in FIG. 11 more easily accessible, as illustrated in FIG. 12, the processing plate 769 can be adjusted in the direction of the arrows 776, 777.

Figure 12:
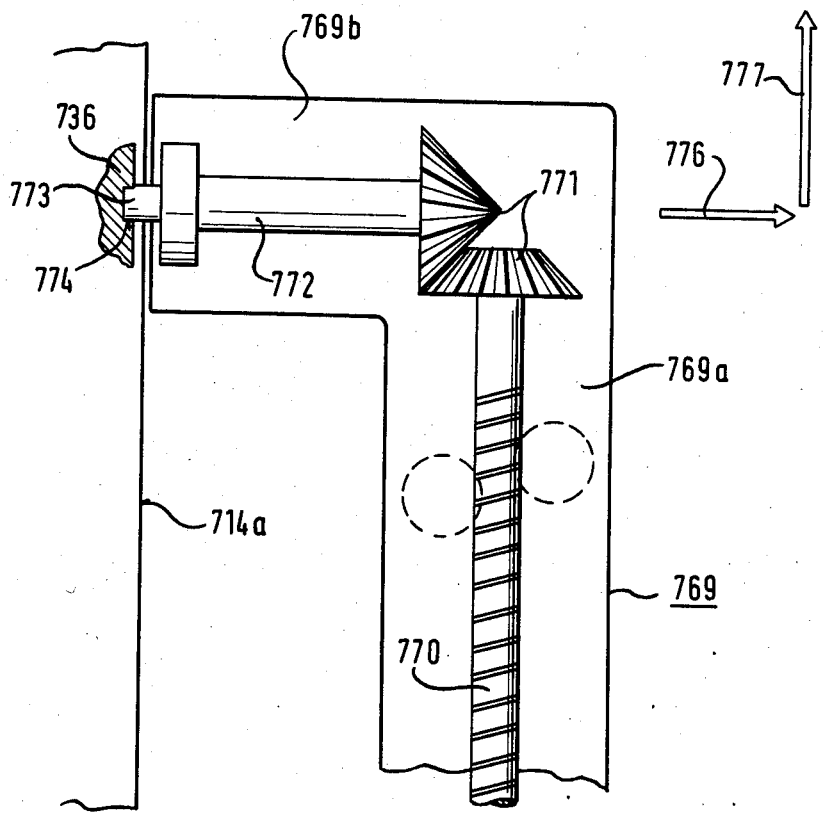
FIG. 12 is a drive diagram of the modification set forth in FIG. 11.

It will be appreciated that processing plates of the type shown in FIGS. 11 and 12 can be installed at several different locations on the machine including its front for operation at the same time.

While specific embodiments of the invention have been shown and described in detail to illustrate the application of the inventive principles, it will be understood that the invention may be embodied otherwise without departing from such principles.

We claim:

1. A wire and band processing machine comprising two processing plates disposed in spaced relation and forming a space therebetween, each of said processing plates having a plurality of holes extending therethrough from one side to the other, a drive system located within said space, said drive system including at least one worm shaft extending parallel to said processing plates, securing means on the sides of said processing plates remote from said space and arranged for mounting processing equipment thereon, at least selected ones of said holes receiving coupling means arranged for drivingly coupling processing equipment with said at least one worm shaft, said coupling means including a worm gear to mesh with said worm shaft, said worm gear having an axis extending transversely of said worm shaft.

2. A wire and band processing machine, as set forth in claim 1, wherein said worm gear is in engagement with only a portion of the circumferential periphery of said worm shaft so that said worm gear can be moved in the direction of its axis into and out of meshed engagement with said worm shaft 30.

3. A wire and band processing machine as set forth in claim 1, including a processing unit incorporating processing equipment secured to said processing plate by said securing means means.

4. A wire and band processing machine, as set forth in claim 3, including a worm gear shaft supporting said worm gear and extending in the axial direction thereof away from said worm gear, said worm gear shaft being supported in one of said holes in one of said processing plates, said worm gear shaft having one end secured to said worm gear and its other end spaced from said worm gear having a coupling arrangement, a counter coupling arrangement being formed on said processing unit for engagement with the coupling arrangement on the other end of said worm gear shaft.

5. A wire and band processing machine, as set forth n claim 4, including a bearing bushing mounted on said processing unit with said worm gear shaft supported within said bearing bushing.

6. A wire and band processing machine, as set forth in claim 4, wherein said coupling arrangement on said other end of said worm gear shaft comprises a diametral slot.

7. A wire and band processing machine, as set forth in claim 4, wherein said coupling arrangement on said other end of said worm gear shaft comprises a diametral rib.

8. A wire and band processing machine, as set forth in claim 3, wherein said processing plates are disposed in parallel relation to one another, said at least one worm shaft extends along the median plane located between said two processing plates.

9. A wire and band processing machine, as set forth in claim 8, wherein said two processing plates combine to form a box-shaped hollow section.

10. A wire and band processing machine, as set forth in claim 9, wherein each said hole of one said processing plate is aligned with a hole in the other said processing plate and one said processing unit can be mounted in each of said holes.

11. A wire and band processing machine, as set forth in claim 10, wherein each said processing unit is connected through one of said holes by one said worm gear in meshed engagement with a portion of the periphery of said at least one worm shaft whereby said processing unit can be placed in and removed from engagement with said at least one worm shaft by moving said worm gear in the axial direction thereof.

12. A wire and band processing machine, as set forth in claim 10, wherein said worm gear shaft is supported in two aligned said holes of said two processing plates and each of the ends of said worm gear shaft includes a coupling arrangement for engagement with a counter coupling arrangement on one said processing unit arranged to be mounted on one of said processing plates.

13. A wire and band processing machine, as set forth in claim 12, wherein said worm gear is located on said at least one worm gear shaft intermediate the ends of said worm gear shaft and is disposed in meshed engagement with said worm shaft over a portion of the peripheral surface thereof so that said worm gear can not be moved into and out of meshed engagement with said at least one worm shaft in the direction of the axis of said worm gear shaft.

14. A wire and band processing machine, as set forth in claim 10, wherein said aligned holes in said two processing plates support a worm gear-worm gear shaft unit, said unit being divided into two partial units along its median plane extending transversely of the axis of said sorm gear shaft, and means for detachably connecting said partial units together in said median plane.

15. A wire and band processing machine, as set forth in claim 14, wherein said connecting means comprises at least a radial wedge located in said median plane, a centering device for centering the partial units of said worm gear-worm gear shaft unit together at the median plane, and an axial clamping device.

16. A wire and band processing machine, as set forth in claim 1, wherein said holes in said two processing plates are arranged in rectilinear rows parallel with said at least one worm shaft.

17. A wire and band processing machine, as set forth in claim 1, wherein at least one of said two processing plates has a dividing plane extending perpendicularly to said at least one processing plate and containing the axis of said at least one worm shaft, and said holes and said securing means located in said at least one processing plate on opposite sides of said dividing plane.

18. A wire and band processing machine, as set forth in claim 17, wherein said holes in said at least one processing plate are arranged in rows on both sides of said dividing plane with the holes in one said row staggered with respect to said holes in the other said row.

19. A wire and band processing machine, as set forth in claim 1, including at least two pairs of processing plates and each pair with at least one corresponding worm shaft therebetween, one processing plate of each pair being disposed in a common plane with the edges of said plates in said common plane being disposed in parallel spaced relation and forming a slot therebetween extending parallel to said worm shafts.

20. A wire and band processing machine, as set forth in claim 19, including bridging pieces for at least partially closing said slot and said bridging pieces being movable along and attachable in said slot and serving as processing abutments.

21. A wire and band processing machine, as set forth in claim 19, including bridging pieces for at least partially closing said slot.

22. A wire and band processing machine, as set forth in claim 1, including a further processing plate extending angularly relative to said two processing plates.

23. A wire and band processing machine, as set forth in claim 22, wherein said further processing plate extends perpendicularly to the planes of said two processing plates.

24. A wire and band processing machine, as set forth in claim 22, wherein said further processing plate is spaced from the plane of the nearer one of said two processing plates forming a gap therebetween.

25. A wire and band processing machine, as set forth in claim 1, including at least one further, each with corresponding holes and at least one further worm shaft parallel to said at least one further processing plate and a common drive means for driving said at least one worm shaft and said at least one further worm shaft.

26. A wire and band processing machine, as set forth in claim 25, wherein said drive means includes at least one cone angle drive.

27. A wire and band processing machine, as set forth in claim 1, wherein said two processing plates comprise a first pair of processing plates, a second pair of processing plates, one first processing plate of each said first and second pairs being in a first common plane, one second processing plate of each said first and second pairs being in a second common plane, edges of said first pair and said second pair of processing plates adjacent each other defining a first gap therebetween, further comprising a third pair of processing plates substantially perpendicular with respect to said first and second common planes, said at least one worm shaft comprises that the first pair, the second pair and the third pair of said processing plates having at least one first, at least one second and at least one third worm shaft, respectively, therebetween, said processing plates of said third pair having edges adjacent and nearer one of said first and second common plates and defining a second gap therebetween, one first processing plate of said third pair of processing plates being substantially aligned with one group of edges defining said first gap, said first gap having a middle plane substantially perpendicular to said first and second common plane parallel to said worm shafts, said second gap having a middle plane substantially parallel to said first and second common planes, a processing area being defined in the area of intersection of said middle planes of said first gap and second gap.

28. A wire and band processing machine, as set forth in claim 1, wherein said two processing plates comprising a first processing plate and a second processing plate, a third processing plate substantially perpendicular to said first and second processing plates, said third processing plate being provided with at least one hole therethrough and securing means arranged for mounting processing equipment thereto, a further worm shaft being associated with said third processing plate and being drivingly coupled to said at least one worm shaft within said space through a hole in one of a first and second processing plates defining said space.

29. A wire and band processing machine, as set forth in claim 28, wherein said further worm shaft associated to said third processing plate being drivingly coupled to said at least one worm shaft within said space by angular drive means.

30. A wire and band processing machine, as set forth in claim 28, wherein said third processing plate is L-shaped having a first leg extending generally parallel to said processing plates defining said space and a second leg extending substantially perpendicular to said processing plates defining said space, said second leg extending between an adjacent one of said processing plates defining said space and said first leg.

31. A wire and band processing machine, as set forth in claim 1, wherein at least one hole of one of said processing plates being aligned with a hole of the other of said processing plates, a worm gear shaft being mounted for rotation in said aligned holes, said worm gear shaft mounting said worm gear, said worm gear being in meshing engagement with said at least one worm shaft located with said space, said worm gear shaft having two ends, at least one of said two ends being provided with a coupling arrangement arranged to be releasably engageable with a counter coupling of an input shaft of a processing unit.

32. A wire and band processing machine, as set forth in claim 31, wherein both ends of said worm gear shaft being provided with a coupling arrangement.

33. A wire and band processing machine, as set forth in claim 31, wherein said coupling arrangement comprising a diametral slot in an end face of said worm gear shaft.

34. A wire and band processing machine, as set forth in claim 31, wherein said coupling arrangement coprises a diametral rib.

35. A wire and band processing machine, as set forth in claim 31, wherein said worm gear shaft being integral from one of its ends to the other and being integral with said worm gear.

36. A wire and band processing machine, as set forth in claim 31, wherein said worm gear and said worm gear shaft being defined by two partial worm gear-worm gear shaft units adjacent respective ones of said processing plates, respectively, each of said partial worm gear-worm gear shaft units comprising a partial worm gear and a partial shaft, said partial shafts being rotatably mounted in the respective holes, said partial worm gears being in contact with each other in a plane parallel to the axis of said at least one worm shaft, said partial worm gears being fixed with respect to each other, both in axial direction and in angular direction about their common axis.

37. A wire and band processing machine, as set forth in claim 30, comprising a processing unit including an input shaft having a counter coupling arrangement for releasable engagement with said coupling arrangement.

38. A wire and band processing machine, as set forth in claim 1, said worm gear being mounted for permanent meshing engagement with said at least one worm shaft and being provided with a coupling arrangement, said processing equipment comprising at least one processing unit, said processing unit being provided with a counter-coupling arrangement for being releasably drivingly coupled to said coupling arrangement, said worm gear remaining in meshing engagement with said worm shaft when said processing unit is detached from the respective processing plate and the counter-coupling arrangement is decoupled from said coupling arrangement.

39. A wire and band processing machine, as set forth in claim 1, comprising two further processing plates coplanar with respective ones of said two processing plates, each coplanar pair of one processing plate and one further processing plate defining a longitudinal slot between adjacent edges thereof, each of said further processing plates having a plurality of holes extending therethrough from one side to the other, a further drive system located in a space between said two further processing plates, said further drive system including at least one further worm shaft extending parallel to said further processing plates and said at least one worm shaft, further securing means on the sides of said further processing plates remote from the space therebetween and arranged for mounting further processing equipment thereon, at least selected ones of said holes of said further processing plates receiving further coupling means arranged for drivingly coupling at least one further processing unit with said at least one further worm shaft, said further coupling means including a worm gear to mesh with said at least one further worm shaft, said worm gear having an axis extending transversely of said at least one further worm shaft.

40. A wire and band processing machine, as set forth in claim 39, at least one of said processing plates and the respective coplanar further processing plate being of symmetrical structure with respect to a plane of symmetry normal to their common plane and following the slot defined between their adjacent edges.

41. A wire and band processing machine, as set forth in claim 39, said two processing plates and said further processing plates defining parallel side walls of respective hollow beam structures, said hollow beam structures receiving said at least one worm shaft and said at least one further worm shaft, respectively.

42. A wire and band processing machine, as set forth in claim 39, at least one third processing plate being provided in a plane inclined with respect to said processing plates and said further processing plates and substantially following said slot, said third processing plate having a plurality of holes extending therethrough from one side to the other, a third drive system located on one side of said third processing plate, said third drive system including at least one third worm shaft extending parallel to said third processing plate, third securing means on the other side of said third processing plate and arranged for mounting third processing equipment thereon, at least selected ones of said holes of said third processing plate receiving third coupling means arranged for drivingly coupling a processing unit of said third processing equipment with said at least one third worm shaft; said third coupling means including a worm gear to mesh with said third worm shaft, said worm gear having an axis extending transversely of said third worm shaft.

43. A wire and band processing machine, as set forth in claim 42, said third processing plate being a side wall of a hollow beam structure receiving said third worm shaft.

44. A wire and band processing machine, as set forth in claims 1, 39 or 42, at least one of said worm shaft, said further worm shaft and said third worm shaft being subdivided into a plurality of worm shaft sections.

45. A wire and band processing machine, as set forth in claim 44, wherein at least one of said worm shaft, said further worm shaft and said third worm shaft is mounted in terminal bearings at respective ends of the machine and in intermediate bearings between said terminal bearings located at the points of subdivision of the worm shaft.

46. A wire and band processing machine, as set forth in claims 39 or 42, wherein at least two of said worm shaft, said further worm shaft and said third worm shaft are commonly driven by a common drive unit and a branching gear unit located at corresponding ends of the respective worm shafts.

47. A wire and band processing machine comprising at least one processing plate having a dividing plane perpendicular to said processing plate, a worm shaft on one side of said processing plate having an axis parallel to said processing plate and within said dividing plane, securing means on the other side of said processing plate on both sides of said dividing plane and arranged for securing processing equipment on both sides of said dividing plane, a plurality of holes through said processing plate on both sides of said dividing plane, selected ones of said holes receiving coupling means arranged for drivingly coupling processing equipment with said worm shaft, said coupling means including a worm gear to mesh with said worm shaft.

48. A wire and band processing machine, as set forth in claim 47, wherein said holes of said processing plate being arranged in two respective rows on both sides of said dividing plane with the holes in one said row staggered with respect to said holes in the other said row.

49. A wire and band processing machine comprising a first processing plate and a second processing plate located in spaced relation in a common plane, each of said first and second processing plates having one edge adjacent the other of said processing plates, respectively, said edges being parallel to each other and forming a slot therebetween, further comprising at least one first and at least one second worm shaft on one side of said first and second processing plates, respectively, and parallel to said edges, further comprising securing means on the other side of said first and second processing plates and arranged for securing processing equipment thereto, further comprising holes through said first and second processing plates, selected ones of said holes receiving coupling means arranged for drivingly coupling processing equipment with the respective worm shaft, the coupling means including a worm gear to mesh with the respective worm shaft, further comprising a third processing plate extending angularly relative to the common plane of said first and second processing plates, said third processing plate being spaced from the adjacent common plane of said first and second processing plates and forming a gap therebetween, further comprising at least one third worm shaft parallel to said third processing plate on one side thereof, securing means on the other side of said third processing plate and arranged for securing processing equipment to said third processing plate, said third processing plate being provided with at least one hole therethrough, said hole being adapted to receive coupling means arranged for drivingly coupling processing equipment to said third worm shaft, said coupling means including a worm gear for meashing engagement with said third worm shaft.

50. A wire and band processing machine comprising two processing plates disposed in spaced relation and forming a space therebetween, each of said processing plates having a plurality of holes extending therethrough from one side to the other, a drive system located within said space, said drive system including at least one worm shaft extending parallel to said processing plates, securing means on the sides of said processing plates remote from said space and arranged for mounting processing equipment thereon, a plurality of said holes receiving coupling means arranged for drivingly coupling processing equipment with said at least one worm shaft, said coupling means including a worm gear to mesh with said worm shaft, said worm gear having an axis extending transversely of said worm shaft.

51. A wire and band processing machine comprising a processing plate having a pair of opposite sides, said processing plate having a plurality of holes extending therethrough from one said opposite side to the other, a drive system located on one side of said processing plate, said drive system including at least one worm shaft extending parallel to said processing plate, securing means on the other side of said processing plate and arranged for mounting releasable processing equipment thereon, a plurality of said holes receiving coupling means arranged for drivingly coupling processing equipment with said at least one worm shaft, said coupling means including a worm gear to mesh with said worm shaft, said worm gear having an axis extending transversely of said worm shaft, said coupling means further including a worm gear shaft rotatable with said worm gear and extending in the axial direction thereof, said worm gear shaft being received by one of said holes, said worm gear shaft having an end spaced from said worm gear, said end having a coupling arrangement located between the opposite sides of said processing plate, counter-coupling arrangement being formed on a releasable processing unit for engagement with the coupling arrangement on said end of said worm gear shaft between the opposite sides of said processing plates, said coupling arrangement (138) and said counter-coupling arrangement (142) being disposed in releasable engagement within said processing plate, said worm gear shaft (136) of the respective coupling means (132, 136, 138, 142) being retained within the respective hole (18) wherein said counter-coupling arrangement being releasable from engagement with said coupling arrangement with the respective worm gear (132) retained in meshing engagement with said worm shaft (130) so that said worm gear shaft (136) can be driven even with said processing equipment (24) separated from said processing plate (12).

52. A wire and band processing machine, as set forth in claim 51, wherein said counter-coupling arrangement (142) being provided on a stub shaft (140) being a part of said processing equipment (24).

53. A wire and band processing machine, as set forth in claim 51, wherein one of said coupling arrangement and said counter-coupling arrangement comprising a rib (142) diametrical with respect to said worm gear shaft (136) and the other of said coupling arrangement and said counter-coupling arrangement comprising a groove (138) diametrically with respect to said worm gear shaft (136).

54. A wire and band processing machine, as set forth in claim 51, wherein said coupling arrangement (138) being housed within the respective hole (18).

55. A wire and band processing machine comprising a processing plate having a pair of opposite sides, said processing plate having a plurality of holes extending therethrough from one said opposite side to the other said opposite side, a drive system located on said one opposite side of said processing plate, said drive system including at least one worm shaft extending parallel to said processing plate, securing means on the other said opposite side of said processing plate and arranged for mounting releasable processing equipment thereon, a plurality of said holes receiving coupling means arranged for drivingly coupling processing equipment with said at least one worm shaft, said coupling means including a worm gear to mesh with said worm shaft, said worm gear having an axis extending transversely of said worm shaft, said coupling means further including a worm gear shaft rotatable with said worm gear and extending in the axial direction thereof, said worm gear shaft being received by one of said holes, said worm gear shaft having an end spaced from said worm gear, said end having a coupling arrangement spaced from the one opposite side of said processing plate, counter-coupling arrangement being formed on a releasable processing unit for engagement with the coupling arrangement on said end of said worm gear shaft, said coupling arrangement (138) and said counter-coupling arrangement (142) being disposed in releasable engagement, said worm gear shaft (136) of the respective coupling means (132,136,138,142) being retained within the respective hole (18) wherein said counter-coupling arrangement being releasable from engagement with said coupling arrangement with the respective worm gear (132) retained in meshing with said worm shaft (130) so that said worm gear shaft (136) can be driven even with said processing equipment (24) separated from said processing plate (12).

56. A wire and band processing machine, comprising a lower hollow beam structure having a longitudinal axis and an upper hollow beam structure having a longitudinal axis, the longitudinal axes of said lower hollow beam structure and said upper hollow beam structure being substantially parallel to each other, said lower and said upper hollow beam structures defining a gap between them, each of said lower hollow beam structure and said upper hollow beam structure comprising at lease one processing plate, said at least one processing plate of said lower hollow beam structure and said upper hollow beam structure being arranged in a substantially common plane, each said processing plate being provided with a plurality of apertures along the respective longitudinal axis, each of said processing plates having securing means on an outer side thereof and arranged for mounting processing equipment thereon, each of said lower hollow beam structure and said upper hollow beam structure receiving at least one worm shaft extending parallel to the respective longitudinal axis, a respective worm gear being associated with at least one of said apertures and being in permanent meshing engagement with the respective worm shaft, said worm gear being provided with a coupling arrangement, the processing equipment comprising processing units which are provided with a counter-coupling arrangement for releasable engagement with said coupling arrangement, said worm gear remaining in meshing engagement with said worm shaft even when the respective processing unit is detached from the respective processing plate and the respective counter-coupling arrangement is decoupled from the respective coupling arrangement.

57. A wire and band processing machine, as set forth in claim 56, each of said worm shafts being subdivided into a plurality of worm shaft sections, each of said worm shafts being rotatably mounted by terminal bearings at respective ends of the machine and by intermediate bearings between said terminal bearings, said intermediate bearings being located at the points of subdivision of the respective worm shaft.

58. A wire and band processing machine, as set forth in claim 56, said upper hollow beam structure and said lower hollow beam structure being interconnected by at least one bridging piece bridging the said gap.

59. A wire and band processing machine, as set forth in claim 56, said worm shafts being driven by a common drive unit through a branching gear unit located at an end of the machine.

60. A wire and band processing machine, comprising a first box structure and a second box structure, each of said box structures receiving a worm shaft therein, each of said box structures being provided with at least one processing plate parallel to the respective worm shaft, each of said processing plates being provided with a plurality of apertures arranged along the respective worm shaft, at least one of said apertures being provided with a worm gear, said worm gear being in permanent meshing engagement with the respective worm shaft, each of said processing plates being provided with securing means for securing processing equipment thereon, said processing equipment comprising processing units, the worm gear being provided with a coupling arrangement, the respective processing unit being provided with a counter-coupling arrangement, said counter-coupling arrangement and said coupling arrangement being releasably couplable for drivingly connecting the respective processing unit to the respective worm gear when the respective processing unit is attached to the respective processing plate, the box structures being engageable with each other by respective walls thereof, the respective worm shafts being drivingly connectable to each other by releasable connecting means at the location of engagement between the respective box structures.

61. A wire and band processing machine, comprising at least one processing plate having a first side face and a second side face, securing means on said first side face arranged for mounting processing equipment thereon, at least one worm shaft adjacent said seoond side face and extending parallel to said processing plate, a plurality of apertures extending through said processing plate from said first side face to said second side face, at least one worm gear associated with at least one of said apertures, said worm gear having an axis perpendicular to said processing plate, being rotatably mounted adjacent said second side face of said processing plate and being in permanent meshing engagement with said at least one worm shaft, said worm gear being provided with a coupling arrangement behind said first side face of said processing plate towards said worm shaft, said processing equipment comprising at least one processing unit, said processing unit being in driving connection with a counter-coupling arrangement, said counter-coupling arrangement and said coupling arrangement being releasably couplable for drivingly connecting said processing unit to said worm gear when said processing unit is attached to the processing plate, said worm gear remaining in permanent meshing engagement with said worm shaft even when said processing unit is detached from said processing plate and said counter-coupling arrangement is decoupled from said coupling arrangement.

62. A wire and band processing machine, comprising a lower hollow beam structure having a longitudinal axis and an upper hollow beam structure having a longitudinal axis, the longitudinal axes of said lower hollow beam structure and said upper hollow beam structure being substantially parallel to each other, said lower and said upper hollow beam structures defining a gap between them, each of said lower hollow beam structure and said upper hollow beam structure comprising at least one processing plate, said at least one processing plate of said lower hollow beam structure and said upper hollow beam structure being arranged in a substantially common plane, each said processing plate being provided with a plurality of apertures along the respective longitudinal axis, each of said processing plates having means on an outer side thereof and arranged for mounting processing equipment thereon, each of said lower hollow beam structure and said upper hollow beam structure receiving at least one worm shaft extending parallel to the respective longitudinal axis, a respective worm gear being associated with at least one of said apertures being rotatably mounted within the respective beam structure and being in permanent meshing engagement with the respective worm shaft, said worm gear being provided with a coupling arrangement, the processing equipment comprising processing units which are drivingly connected with a counter-coupling arrangement for releasable engagement with said coupling arrangement, said worm gear remaining in meshing engagement with said worm shaft even when the respective processing unit is detached from the respective processing plate and the respective counter-coupling arrangement is decoupled from the respective coupling arrangement, said coupling arrangement being located behind said outer side of the respective processing plate towards the interior of the respective beam structure.

63. A wire and band processing machine, comprising a first box structure and a second box structure, each of said box structures receiving a worm shaft therein, each of said box structures being provided with at least one processing plate parallel to the respective worm shaft, each of said processing plates being provided with a plurality of apertures arranged along the respective worm shaft, at least one of said apertures being provided with a worm gear, said worm gear being rotatably mounted within the respective box structure and being in permanent meshing engagement with the respective worm shaft, each of said processing plates being provided with securing means on an outer side thereof for securing processing equipment thereon, said processing equipment comprising processing units, the worm gear being provided with a coupling arrangement behind said outer side towards the interior of the respective box structure, the respective processing unit being provided with a counter-coupling arrangement, said counter-coupling arrangement and said coupling arrangement being releasably couplable for drivingly connecting the respective processing unit to the respective worm gear when the respective processing unit is attached to the respective processing plate, the box structures being engageable with each other by respective walls thereof, the respective worm shafts being drivingly connectable to each other by releasable connecting means at the location of engagement between the respective box structures.

* * * * *